US006644409B1

(12) United States Patent
Strømberg et al.

(10) Patent No.: US 6,644,409 B1
(45) Date of Patent: Nov. 11, 2003

(54) RISER GUIDE SYSTEM

(75) Inventors: Håkon Strømberg, Oslo (NO); Tom Strandbakken, Fetsund (NO)

(73) Assignee: Moss Maritime AS, Lysaker (NO)

( * ) Notice: Subject to any disclaimer, the term of this patent is extended or adjusted under 35 U.S.C. 154(b) by 0 days.

(21) Appl. No.: 10/137,363

(22) Filed: May 3, 2002

(51) Int. Cl.[7] ..... E21B 29/12

(52) U.S. Cl. ..... 166/349; 166/342; 166/241.1; 405/224.2

(58) Field of Search ..... 166/349, 342, 166/341, 366, 241.1; 405/224.2

(56) References Cited

U.S. PATENT DOCUMENTS

| | | | | | |
|---|---|---|---|---|---|
| 3,313,358 | A | * | 4/1967 | Postlewaite et al. | 175/7 |
| 3,528,497 | A | * | 9/1970 | Lehman | 166/360 |
| 4,076,337 | A | * | 2/1978 | Childress | 384/24 |
| 4,090,368 | A | * | 5/1978 | Bell et al. | 405/201 |
| 4,126,183 | A | * | 11/1978 | Walker | 166/338 |
| 4,136,633 | A | * | 1/1979 | Homer et al. | 114/264 |
| 4,395,160 | A | * | 7/1983 | deJong | 405/224.4 |
| 4,469,181 | A | * | 9/1984 | Kellett | 166/341 |
| 4,505,614 | A | * | 3/1985 | Anschutz | 405/195.1 |
| 4,844,660 | A | * | 7/1989 | Ortemond | 405/224 |
| 4,895,481 | A | * | 1/1990 | Pepin-Lehalleur et al. | 405/224 |
| 5,158,397 | A | * | 10/1992 | Koos et al. | 405/195.1 |
| 5,950,737 | A | * | 9/1999 | Chou et al. | 175/5 |
| 6,260,625 | B1 | * | 7/2001 | Phan et al. | 166/355 |
| 6,352,116 | B1 | * | 3/2002 | Børseth | 166/359 |
| 6,375,391 | B1 | * | 4/2002 | Børseth et al. | 405/224.4 |

FOREIGN PATENT DOCUMENTS

| | | |
|---|---|---|
| WO | WO 00/58598 | 10/2000 |

* cited by examiner

*Primary Examiner*—Robert E. Pezzuto
*Assistant Examiner*—Thomas A. Beach
(74) *Attorney, Agent, or Firm*—Birch, Stewart, Kolasch & Birch, LLP

(57) ABSTRACT

A riser guide system is for use on a floating offshore platform, the platform having a topside and a substructure having a lower pontoon, and at least one riser extends from a subsea location to the topsides. A permanent guide is secured to the pontoon, a primary guide is located in the permanent guide, a secondary guide is located in the primary guide, and riser guides are located in the secondary guide and face the riser. In a method for installing the riser guide system, both the primary guide, the secondary guide and the riser guides are placed around the riser at the topsides, and lowered down to the pontoon.

14 Claims, 12 Drawing Sheets

RISER GUIDE SYSTEM

FIELD OF THE INVENTION

The invention relates to a riser guide system for use on a floating offshore platform. The platform comprises a topsides and a substructure having a lower pontoon, and at least one riser extends from a subsea location to the topsides.

The invention also relates to a method for installing a riser and a riser guide system on a floating offshore platform, and methods for removing riser guides on a floating offshore platform.

DESCRIPTION OF THE BACKGROUND ART

In offshore hydrocarbon production, hydrocarbons flow from a subterranean formation into a well, and up to the sea bed. From the sea bed the hydrocarbons flow to a platform via risers. Risers can also be used for water or gas injection, in order to maintain the pressure in the reservoir, or for supplying pressurised hydraulic oil and electric signals for energising and controlling subsea equipment which is used in the hydrocarbon production.

In shallow and medium depth waters fixed platforms resting on the sea bed are used. In deep seas a structure resting on the sea bed would be too large, and therefore floating platforms are used. Due to the motion of the sea, a floating platform is almost always moving. The risers may be stiff steel risers, which are prone to overstressing due to the motions of the floating platform. In order to overcome the problem of the moving platforms, flexible risers may be used. Flexible risers are, however, more expensive than stiff risers.

Irrespectively of what type of risers are used, they must to some extent be laterally guided. Typically riser guides will be located at the pontoon. The riser guides may include sliding pads which are located close to or in abutment with the riser, for laterally guiding the riser during the movement of the platform.

WO 00/58598 discloses a riser guide system comprising a framework which is located around the riser and secured to the platform. Rollers, in the illustrated embodiment having a number of four, are located in the framework, close to or in abutment with the riser, for laterally guiding the riser.

Usually riser guides will be installed subsea, maybe at the pontoon 20–30 meter below the sea surface. This installation may be carried out by divers or an ROV (remotely operated vehicle). This can be dangerous and problematic, and it is therefore desirable to find other ways to do this installation, without divers or an ROV.

Riser guides will after some time be worn, and they must therefore be replaced. Divers or an ROV may be used, but again this can be dangerous and problematic, and is desirable to find other ways of replacing the riser guides.

BRIEF SUMMARY OF THE INVENTION

An object of the invention is to provide a riser guide system which allows installing and replacing the riser guides from the topsides. A further object is to provide a method for installing a riser and a riser guide system on a floating offshore platform, in which offshore operations shall be carried out from the topsides. A further object is to provide a method for removing riser guides on a floating offshore platform, which shall be carried out from the topsides. A particular object is that the invention shall be suitable for stiff risers.

The invention thus relates to a riser guide system for use on a floating offshore platform. The platform comprises a topsides and a substructure having a lower pontoon, and at least one riser extends from a subsea location to the topsides. The system comprises:

- a permanent guide having the shape of a housing and having a through-going opening for the riser, the permanent guide is secured to the pontoon,
- a primary guide having the shape of a housing and having a through-going opening for the riser, the primary guide is located in the permanent guide,
- a secondary guide having the shape of a housing and having a through-going opening for the riser, the secondary guide is located in the primary guide, and riser guides located in the secondary guide and facing the riser.

The riser guide system according to the invention may be used both for flexible and stiff risers. The invention is, however, regarded as particularly favourable for stiff risers, which have a greater need for guiding than flexible risers.

When installing a riser and a riser guide system according to the invention on a floating offshore platform, the following steps are carried out:

a) securing a permanent guide having a through-going opening to the pontoon, the permanent guide has the shape of a housing, b) placing a primary guide having a through-going opening around a lower riser section at the topsides, the primary guide has the shape of a housing, c) lowering the lower riser section and the primary guide down to and into the permanent guide, d) connecting another riser section to the lower riser section and interconnecting more riser sections into a riser, and lowering the riser from the topsides until it extends to a subsea location, e) placing a secondary guide having a through-going opening around the riser at the topsides, the secondary guide has the shape of a housing, the riser guides are located in the secondary guide and face the riser, and f) lowering the secondary guide down to and into the primary guide.

The securing of the permanent guide to the pontoon is preferably done prior to the offshore installation of the riser. The lowering of the riser, the primary guide and the secondary guide, which are done offshore, can be carried out from the topsides.

The invention provides two methods for removing riser guides which form part of a riser guide system according to the invention.

In the first method the following steps are carried out:

a) lifting the secondary guide up from the primary guide to the topsides, and b) removing the riser guides from the secondary guide.

In the second method the following steps are carried out:

a) lifting the primary guide including the secondary guide up from the permanent guide to the topsides, and b) removing the riser guides from the secondary guide.

Both the lift of the primary guide and the lift of the combination of the primary guide and the secondary guide can be carried out from the topsides. A secondary guide with new or repaired riser guides can then be placed around the riser, and lowered in place. A replacement of the riser guides from the topsides has thereby been carried out.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be explained in closer detail with reference to the enclosed drawings, which are given by way of illustration only, and thus are not limitative of the present invention, and in which.

DETAILED DESCRIPTION OF THE INVENTION

Figure 1:
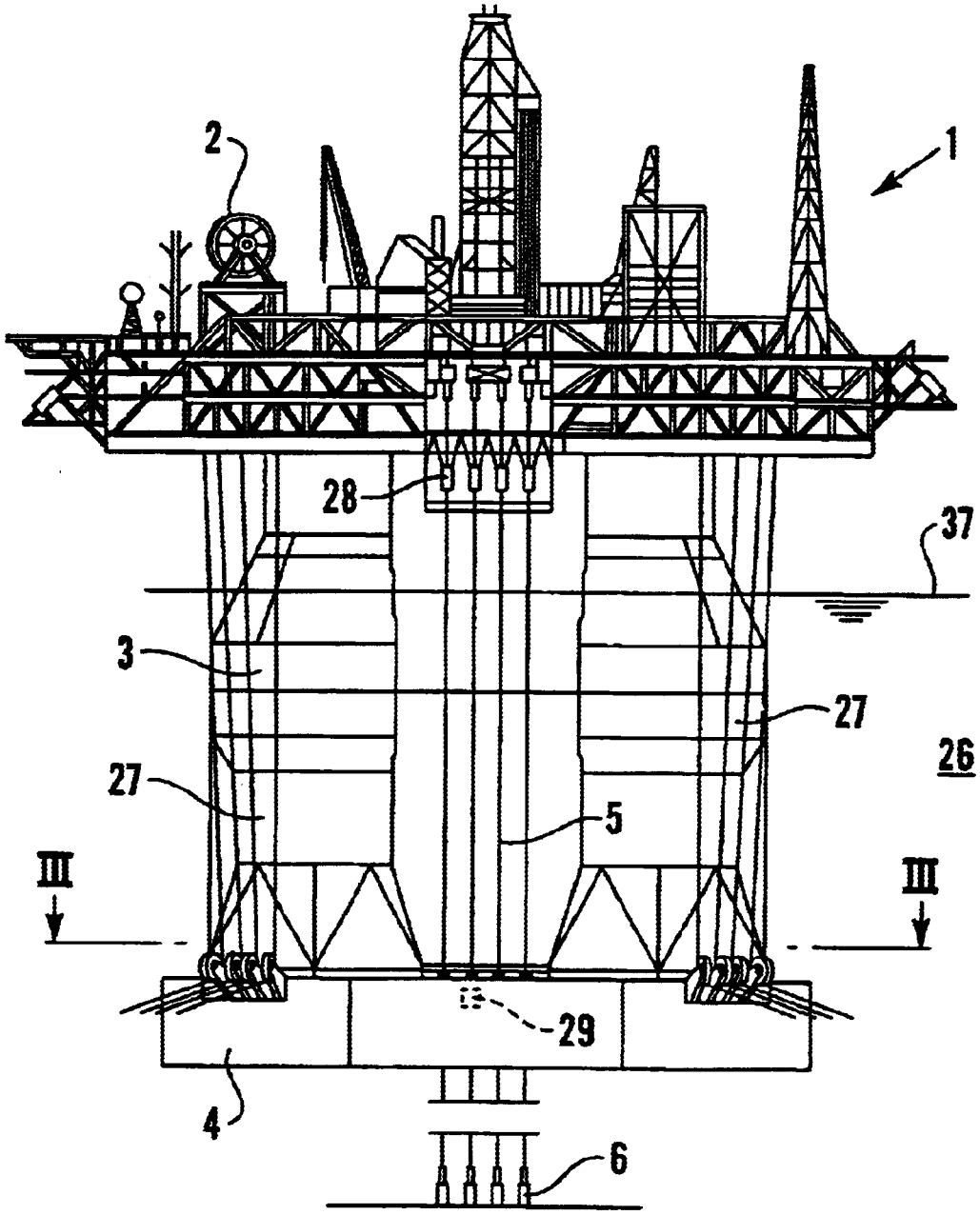
FIG. 1 illustrates a floating platform in the sea.

FIG. 1 illustrates a floating offshore platform 1 in the sea 26. The waterline is designated by reference numeral 37. The platform comprises a topsides 2 and a substructure 3 having columns 27 and a lower pontoon 4. Several risers 5 (four are illustrated) extend from a subsea location 6 to the topsides 2. The subsea location is a manifold in which piping from several hydrocarbon-producing wells in a reservoir are interconnected. On the topsides 2 the risers 5 are terminated in Christmas-trees 28 containing various valves for controlling the hydrocarbon production. Most of the risers are used for bringing hydrocarbons from the manifold to the topsides. One of the risers may be an umbilical, i.e. a riser containing piping for pressurised oil for energising valves in the manifold, and electric cables for controlling the valves. Other risers may be injection risers, for injecting pressurised water or gas in the reservoir in order to maintain the pressure in the reservoir.

Due to the motion of the sea, the platform 1 is almost always in motion. The illustrated risers 5 are stiff steel risers, and in order to avoid overstressing the risers during the motion of the sea, the risers 5 are guided by a riser guide system 29 according to the invention, located at the pontoon 4. The riser guide system according to the invention comprises a permanent guide, a primary guide, a secondary guide and riser guides located in the secondary guide.

Figure 2:
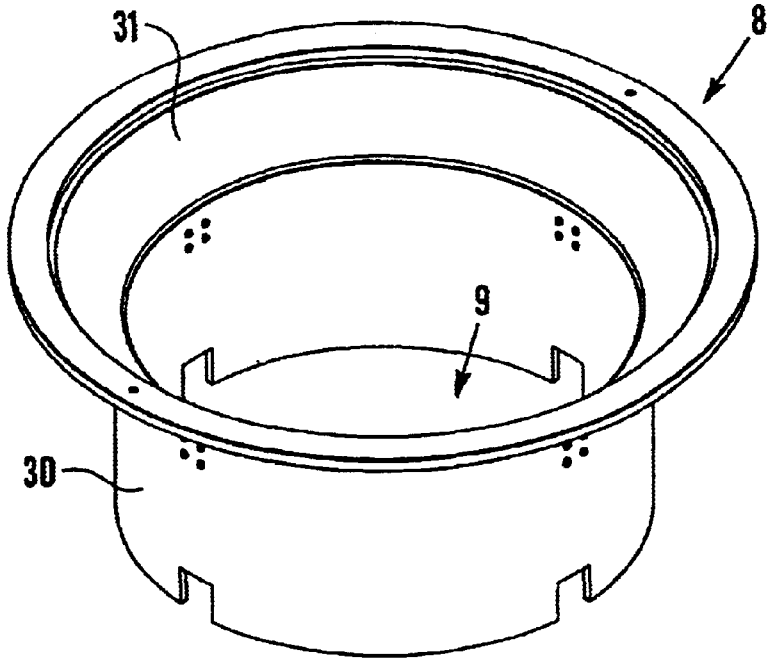
FIG. 2 illustrates a permanent guide according to the invention.

FIG. 2 illustrates a permanent guide 8 according to the invention. The permanent guide 8 has the shape of a housing and consist of a lower cylindrical portion 30 and an upper frusto-conical portion 31, and have a through-going opening 9 for the riser 5 (not illustrated).

Figure 3:
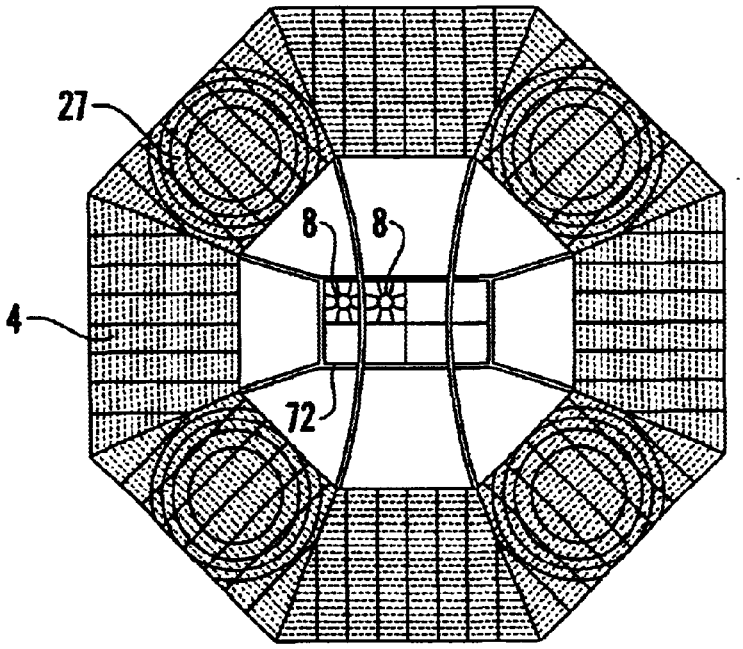
FIG. 3 illustrates the location of the permanent guide.

FIG. 3 is a sectional view taken through III—III in FIG. 1, and illustrates four columns 27, the pontoon 4 and two permanent guides 8 located in a trusswork 72 in the centre of the pontoon.

Figure 4:
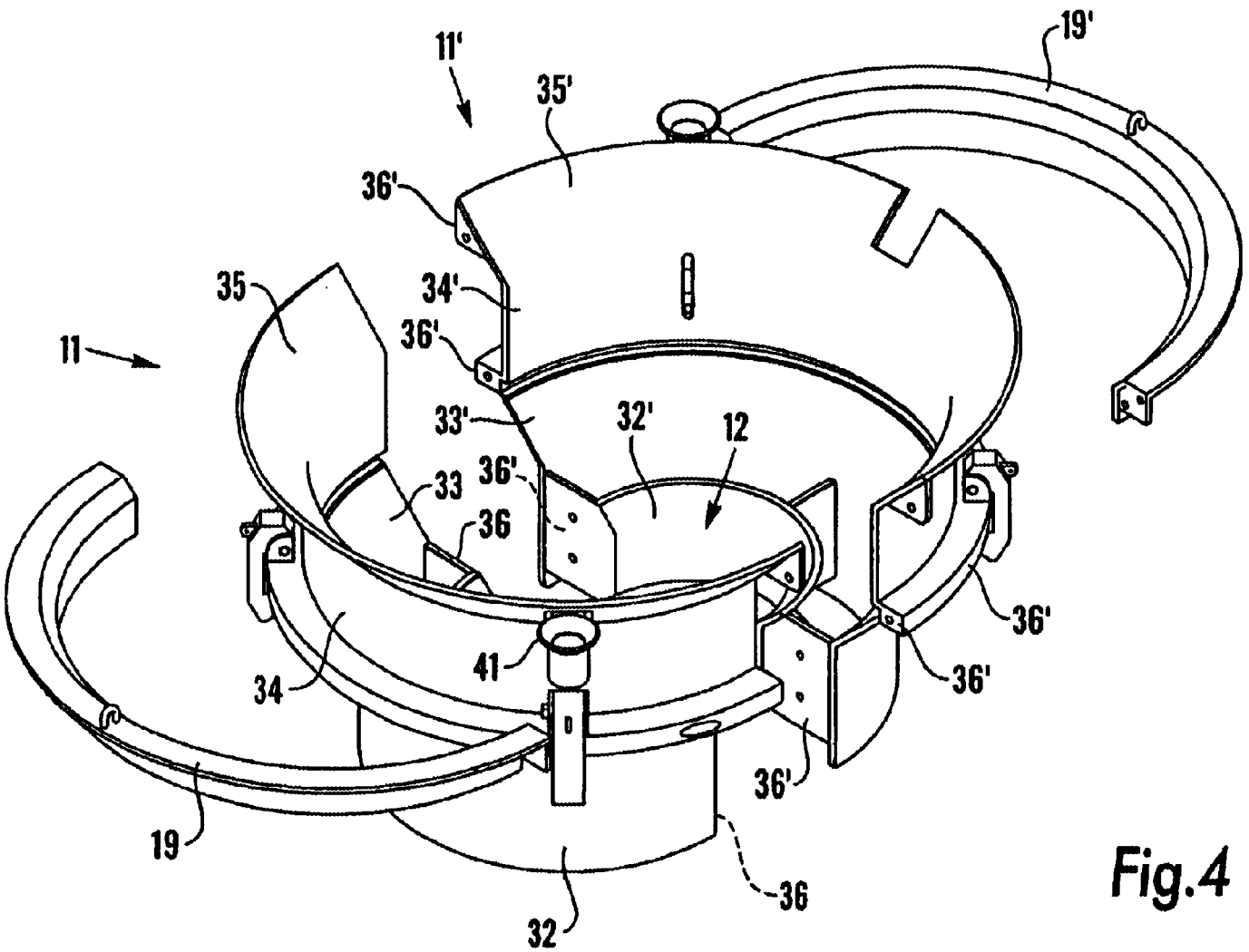
FIG. 4 illustrates a primary guide according to the invention.

FIG. 4 illustrates a primary guide 11, 11' according to the invention, having the shape of a housing and having a through-going opening 12 for the riser 5 (not illustrated). The primary guide is longitudinally divided in two halves 11, 11' interconnectable by bolting. The interconnectability is achieved by flanges 36, 36' of the two halves 11, 11', and not illustrated bolting. Each half of the primary guide consists of a lower cylindrical portion 32, 32', a lower frusto-conical portion 33, 33', an upper cylindrical portion 34, 34' and an upper frusto-conical portion 35, 35'.

The dividing of the primary guide into two halves 11, 11' enables placing the primary guide around the riser 5 by placing the two halves 11, 11' facing each other with the riser in the opening 12, and then interconnect the two halves into the complete primary guide. It is understood that the primary guide could have been divided in the longitudinal direction in more than two interconnectable parts, "longitudinal direction" referring to the longitudinal direction of the riser.

Figure 5:
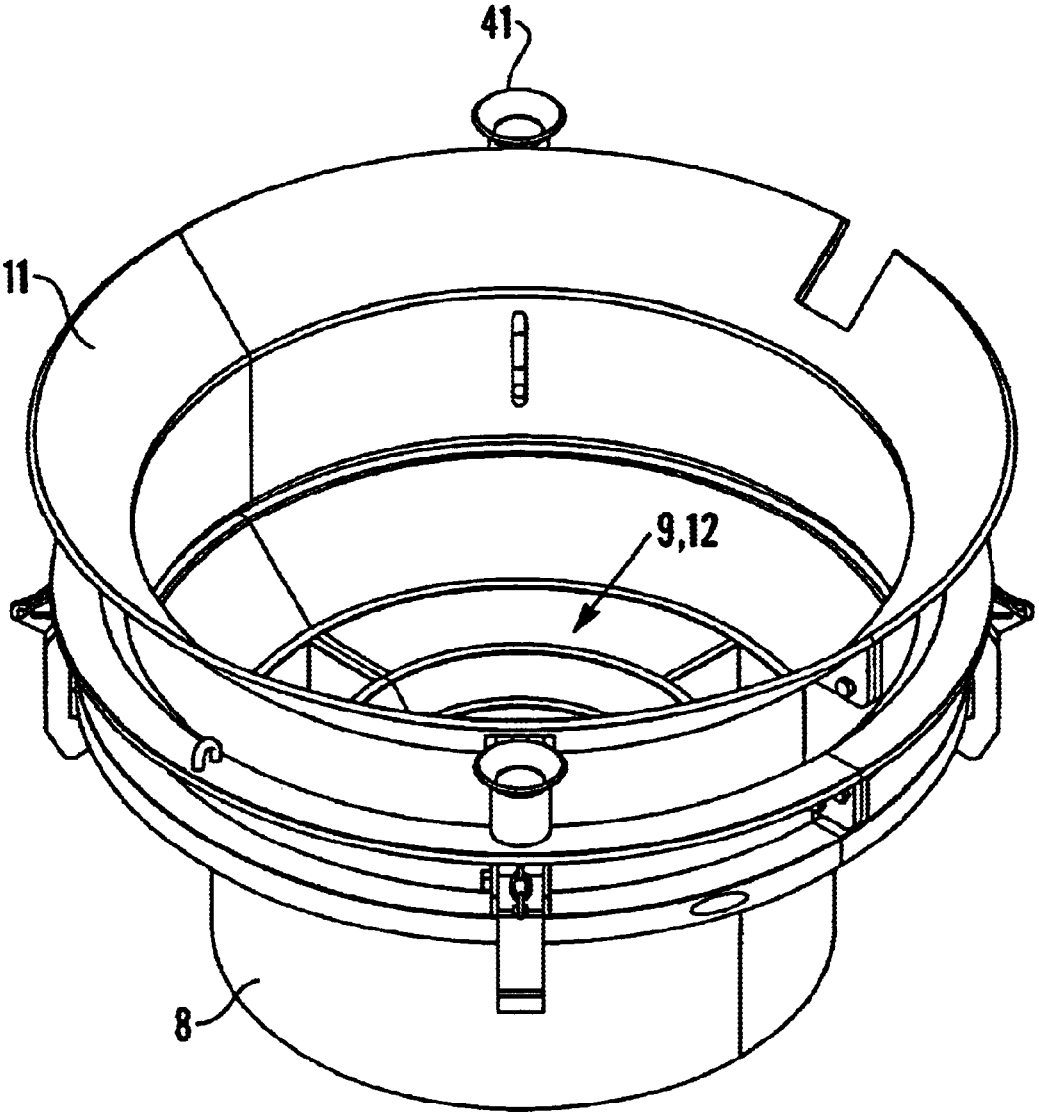
FIG. 5 illustrates the primary guide inside the permanent guide.

FIG. 5 illustrates the primary guide 11 located inside the permanent guide 8. The openings 9, 12 of the permanent guide and the primary guide are coaxial, for the through-going, not illustrated riser.

Figure 6:
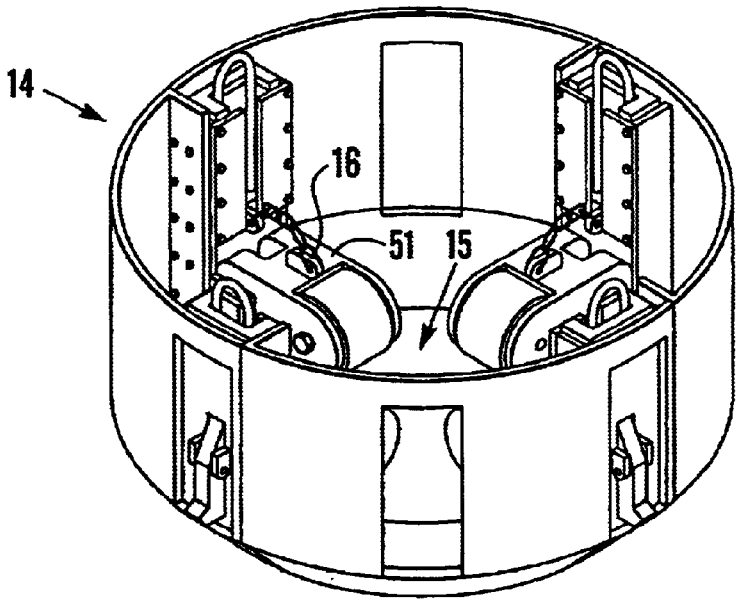
FIG. 6 illustrates a secondary guide according to the invention.

FIG. 6 illustrates a secondary guide 14 according to the invention, having the shape of a cylindrical housing and having a through-going opening 15 for the riser 5. Four riser guides 16 are located in the secondary guide 14.

Figure 7:
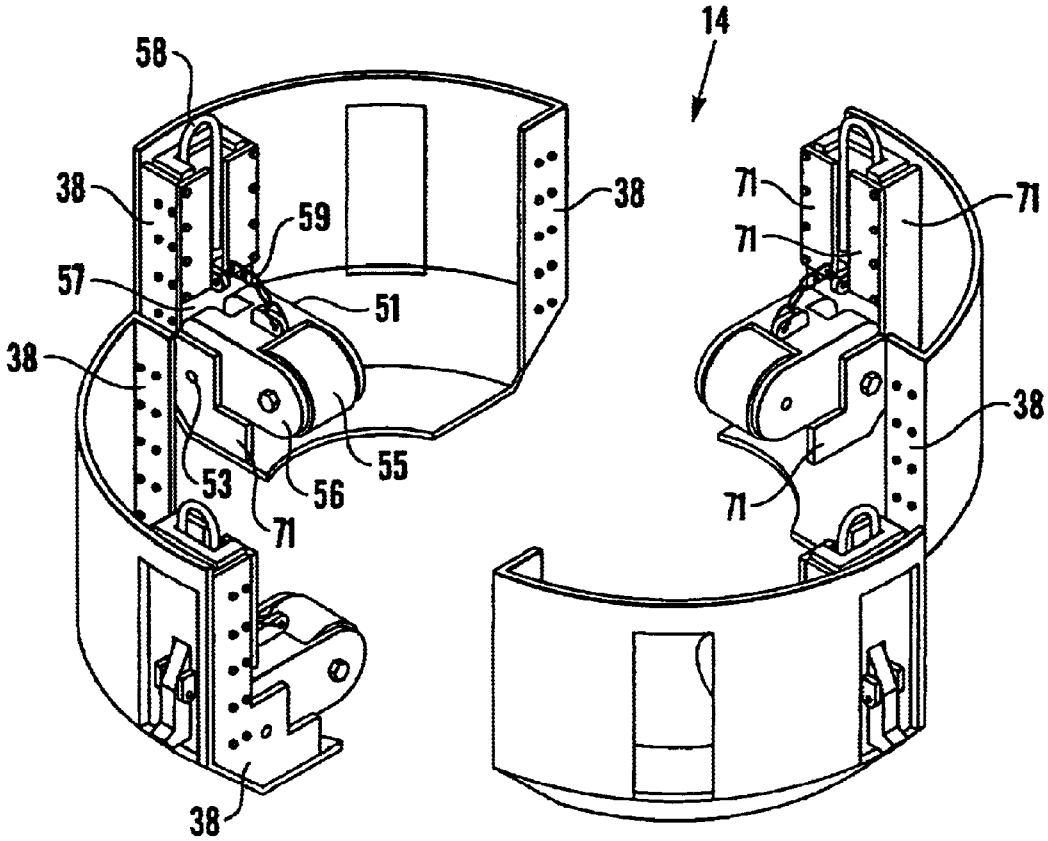
FIG. 7 illustrates the secondary guide divided in four parts.

Like the primary guide, the secondary guide 14 is preferably longitudinally divideable in two or more mechanically interconnectable parts. This is illustrated in FIG. 7, which illustrates the secondary guide 14 divided in four parts. The four parts of the secondary guide are interconnectable by means of flanges 38 and not illustrated bolting.

Each of the illustrated riser guides 16 comprise a support arm 51 essentially radially arranged in the secondary guide 14. An outer end of the support arm, i.e. the end of the support arm 51 pointing away from the centre of the secondary guide 14, is rotatably mounted about a horizontal axis 53 in steel plates 71 integral with secondary guide 14. A roller 55 is rotatably mounted about a horizontal axis 56 in the inner end of the support arm 51, "inner end" being understood as the end pointing towards the centre of the secondary guide 14. The support arm 51 and the roller 55 are held in place by bolting in the axes' 53, 56. The support arm 51 and the roller 55 are thereby tiltable between a lower illustrated position in which the roller 55 is close to or in abutment with the riser 5, for laterally guiding the riser 5 during movement of the platform 1 in the sea 26, and a not illustrated upper position away from the riser 5.

A wedge 57 provided with a lifting bail 58 for lifting gear is via a chain 59 connected to the support arm 51. The wedge 57 is slideable in a vertical track formed by steel plates 71 integral with the secondary guide 14. The wedge 57 is vertically movable between an illustrated lower position between the outer end of the support arm 51 and the secondary guide 14 and an upper not illustrated position above the support arm 51. In the upper position the wedge 57 lifts the support arm 51 and the roller 55 to the upper position by means of the chain 59.

When lifting gear is connected to the lifting bails 58 and tensioned, the wedges are lifted to their upper position, causing the rollers 55 to move to their upper, inactive position away from the riser 5. Thus, when lifting or lowering the secondary guide 14 by lifting gear connected to the lifting bails 58, the rollers will be in their upper, inactive position. When the lifting gear is slackened, the rollers 55 will move to their lower, active position.

The illustrated riser guides 16 are favourable, but other riser guides, e.g. having sliding pads in abutment with the riser 5, could be used together with the invention.

Figure 8:
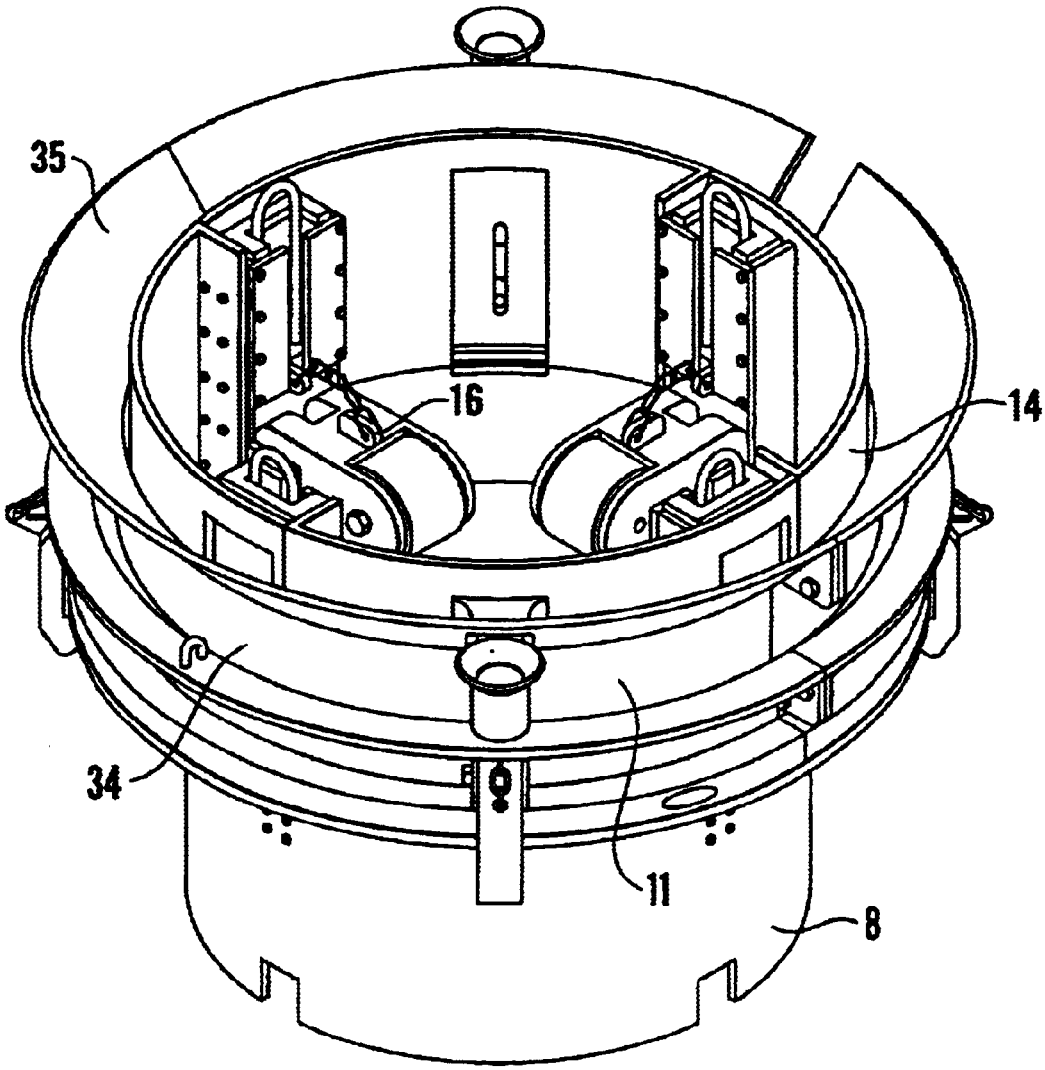
FIG. 8 illustrates a combination of the permanent guide, the primary guide and the secondary guide.

FIG. 8 illustrates a combination of the permanent guide 8, the primary guide 11 and the secondary guide 14. The primary guide 11 is located in the permanent guide 8, and the secondary guide 14 is located in the primary guide 11.

Further aspects of the invention will now be explained in connection with an explanation of the methods according to the invention.

Figure 9:
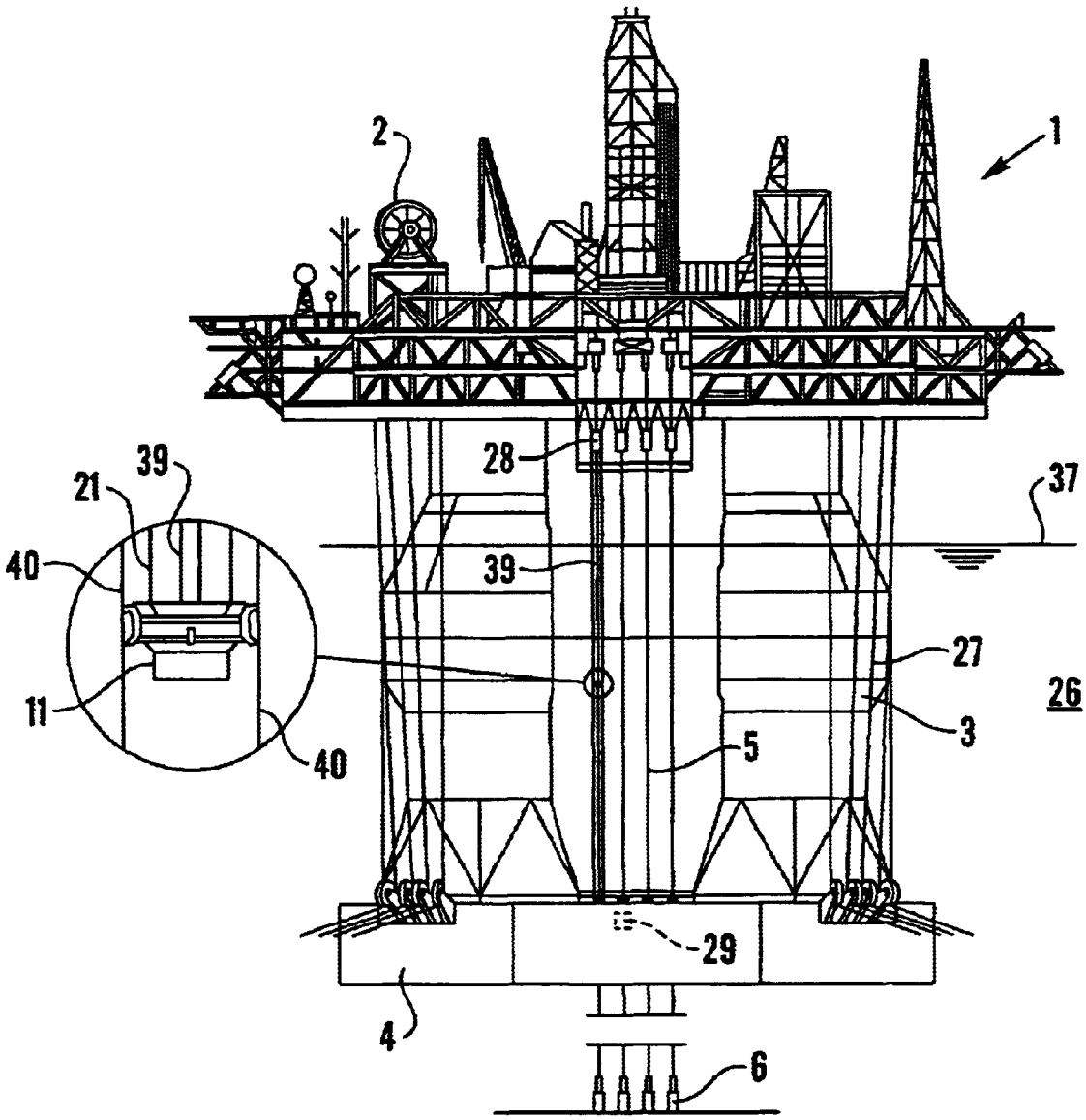
FIG. 9 illustrates lowering the primary guide from the topsides to the pontoon.
Figure 10:
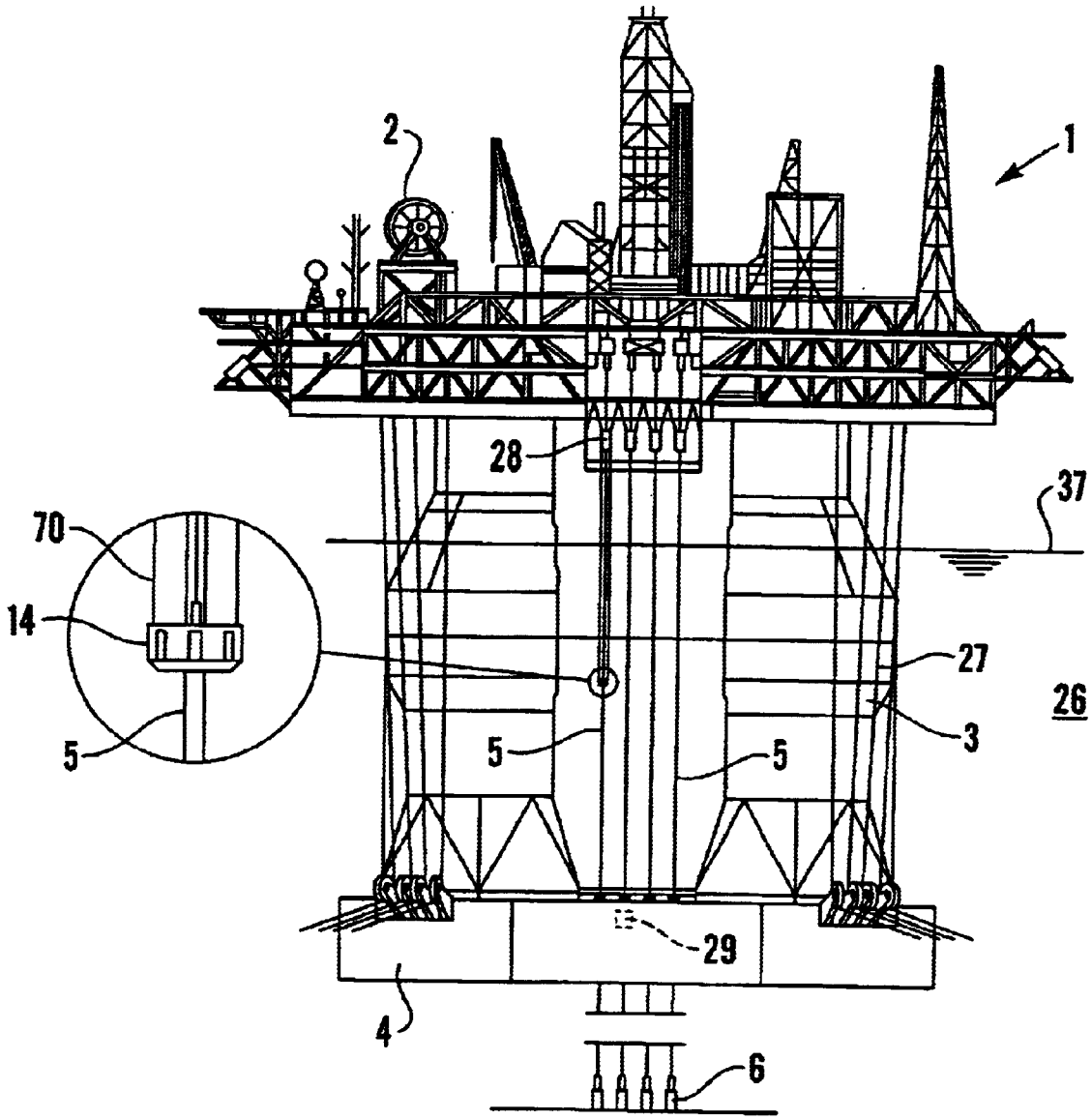
FIG. 10 illustrates lowering the secondary guide from the topsides to the pontoon.

The invention relates to a method for installing a riser 5 and a riser guide system on a floating offshore platform 1. The method comprises the following steps:

a) Securing a permanent guide 8 to the pontoon 4. This step will have to be carried out either by divers or an ROV (remotely operated vehicle), or, which is preferred, the permanent guide 8 is secured to the pontoon 4 during the production of the platform 1, at a ship-yard.

b) Placing the primary guide 11 around a lower riser section at the topsides 2. The illustrated topsides 2 has three decks, and the primary guide 11 is placed around the lower riser section at a suitable deck. A primary guide in one piece may be used, and in this case the riser section must be put through the opening of the primary guide. Alternatively a primary guide which is longitudinally divideable in two or more interconnectable parts (see FIG. 4) may be used, which allows placing the parts around the lower riser section and then interconnect the parts into the primary guide 11.

c) Lowering the lower riser section and the primary guide 11 down to and into the permanent guide 8. The lowering is illustrated in FIG. 9, in which the lower riser section is designated by reference numeral 39. The lowering is carried out by lifting gear formed by wires 21. The primary guide is during the lowering temporary connected to a lower riser coupling, i.e. a coupling which is used for connecting the riser to the manifold at the subsea location 6. During the lowering the primary guide 11 and the lower riser section 39 are guided by guide wires 40 extending from the topsides 2 to the permanent guide 8. The guide wires 40 go through guidewire-funnels 41 on the primary guide 11 (see FIG. 5), and thereby guide the primary guide and the lower riser section into the permanent guide. The lower cylindrical portion 32 of the primary guide (see FIG. 4) fits into the cylindrical portion 30 of the permanent guide. After the primary guide 11 has been lowered into the permanent guide 8, the lower riser coupling is released from the primary guide, for further lowering of the riser.

d) Connecting another riser section to the lower riser section and interconnecting more riser sections into a riser 5, and lowering the riser 5 from the topsides 2 until it extends to the subsea location 6.

e) Placing a secondary guide 14 having a through-going opening around the riser 5 at the topsides 2. The riser guides 16 are located in the secondary guide 14 and face the riser 5. A secondary guide in one piece may be used, in which case the riser 5 must be put through the opening of the secondary guide. Alternatively a secondary guide which is longitudinally divideable in two or more interconnectable parts (see FIG. 7) may be used, which allows placing the parts around the riser 5 and interconnect the parts into the secondary guide 14.

f) Lowering the secondary guide 14 down to and into the primary guide 11. The lowering is illustrated in FIG. 10. The lowering is carried out by lifting gear formed by wires 70. The secondary guide 14 is sufficiently guided by the riser 5, and therefore no guidewires are required. The upper frusto-conical portion 35 of the primary guide 11 guides the secondary guide 14 into the upper cylindrical portion 34 of the primary guide (see FIG. 8).

When using the illustrated riser guide 16, the lifting gear 70 is connected to the lifting bail 58 during the lowering of the secondary guide 14, see FIG. 7. The rollers 55 are therefore in their upper, inactive position during the lowering. When the secondary guide 14 has arrived in the primary guide 11, the lifting gear 70 is slackened, and, as discussed with reference to FIG. 7, the rollers 55 move to their lower, active position in which they guide the riser 5.

The invention also relates to a method for removing riser guides on a floating offshore platform 1. The riser guides form part of the riser guide system according to the invention. The above discussed riser guides 16 may be used, but the method can also be used for other riser guides located in the secondary guide 14. The method comprises the following steps:

a) Lifting the secondary guide 14 up from the primary guide 11 to the topsides 2. This step is the opposite of the above discussed step f).

b) Removing the riser guides from the secondary guide 14. If the illustrated riser guides 16 are used, this can be done by un-tightening and removing bolting which hold the support arms 51 and the rollers 55 in place. Preferably, in order to obtain easy access to the support arms and the rollers, the secondary guide 14 is first divided in parts, and these parts are removed from the riser 5, after the secondary guide 14 has been lifted up to the topsides 2.

In an alternative method for removing the riser guides, the following steps are carried out:

a) Lifting the primary guide 11 including the secondary guide 14 up from the permanent guide 8 to the topsides 2.

b) Removing the riser guides 16 from the secondary guide 14. Preferably, in order to obtain easy access to the support arm and the roller, the primary guide 11 is divided in parts which are removed from the secondary guide 14 after the primary guide 11 and the secondary guide 14 have been lifted up to the topsides 2.

Alternatively the secondary guide 14 may be divided in parts which are removed from the primary guide 11 after the primary guide 11 and the secondary guide 14 have been lifted up to the topsides 2.

The invention also relates to a favourable mechanism for securing and releasing the primary guide to the permanent guide, which is illustrated in FIGS. 11–14.

The illustrated primary guide 11 is provided with hooks 17, and the illustrated permanent guide 8 is provided with at least one holding element 18 which can be engaged by the hooks 17. The illustrated holding element 18 is formed by a radially projecting flange of the permanent guide 8, see FIG. 11.

The primary guide 11 is provided with at least one lifting element 19 provided with connections 20 for lifting gear 21.

The lifting element 19 is connected to the hooks 17 via mechanical links 22. In the embodiment illustrated in FIGS. 11–14 the lifting element 19 is formed by a lifting ring, the connections 20 for lifting gear are formed by lifting lugs, the lifting gear 21 is formed by wires and the mechanical links 22 are formed by chains.

The hooks 17 are provided with gripping portions 24 which can engage the holding flange 18. The hooks 17 are pivotable about horizontal axes 23 located above the gripping portions 24, and the hooks 17 are thereby movable between a free position (see FIGS. 11 and 12) in which the primary guide 11 can be lifted up from the permanent guide 8, and an engaged position (see FIGS. 13 and 14) in which the hooks 17 engage the flange 18.

Figure 14:
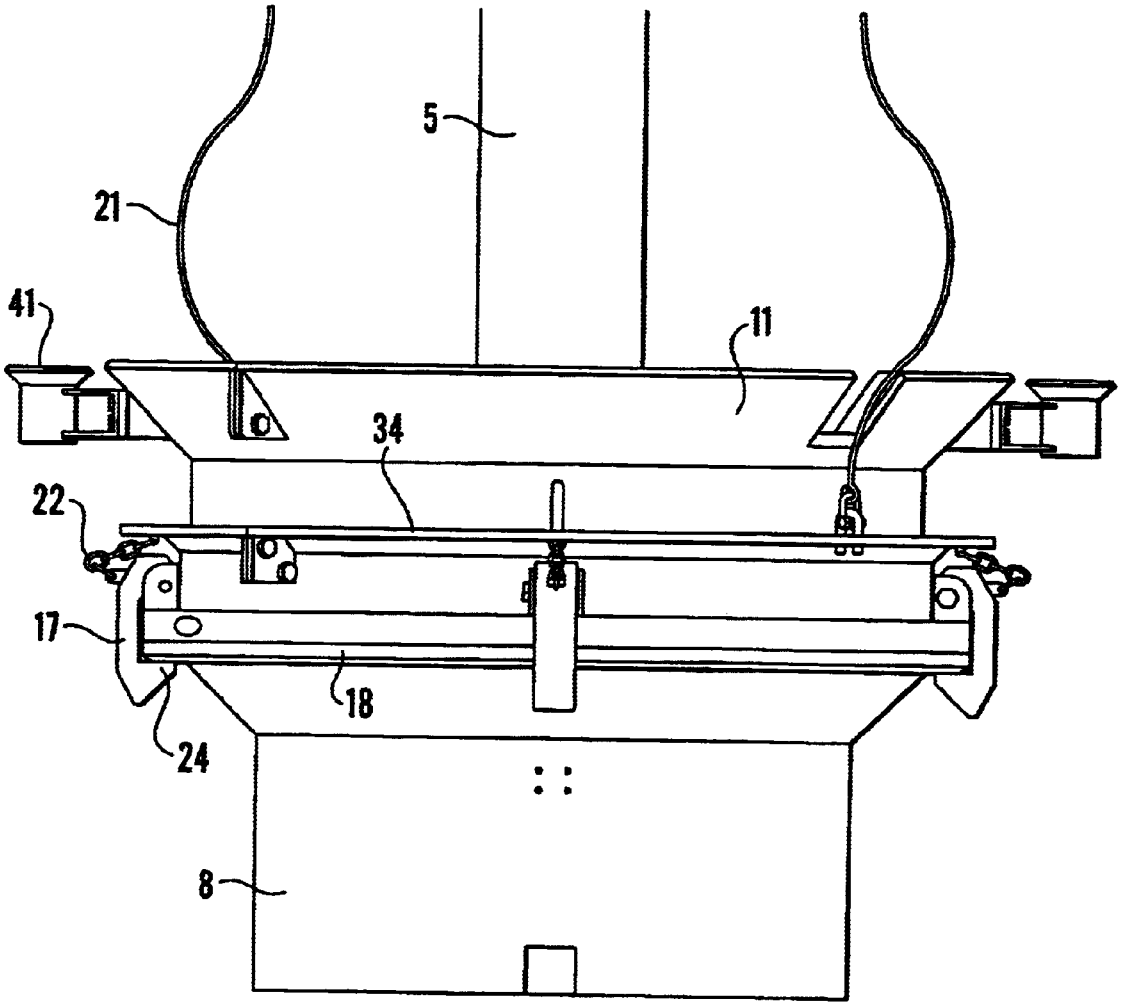

The lifting ring 19 is movable between an upper position (FIGS. 11 and 12) and a lower position (FIG. 14). For this purpose the lifting ring 19 is slideable on the outside of the upper cylindrical portion 34 of the primary guide 11. The mechanical links 22, i.e. the chains, are connected to the hooks 17 radially outwards from the axes 23.

In its upper position, the lifting ring 19 has via the chains 22 lifted the hooks 17 to free position. The lifting ring 19 and the primary guide 11 can thereby be lifted by the lifting wires 21, and lowered down to or lifted up from the permanent guide 8. Preferably, in order to transfer the weight of the primary guide 11 to the lifting ring 19, in its upper position the lifting ring 19 abuts the primary guide 11.

When the lifting ring 19 is in its lower position (FIG. 14), the chains 22 are slack and the hooks 17 are allowed to move to their engaged position. The lifting ring 19 is then located with small clearances in recesses 25 (see FIG. 13) between the hooks 17 and the upper cylindrical portion 34 of the primary guide 11, and the lifting ring 19 thereby blocks movement of the hooks 17 and locks the hooks 17 in engaged position.

FIGS. 11–14 illustrate a sequence of lowering the primary guide 11 into the permanent guide 8.

Figure 11:
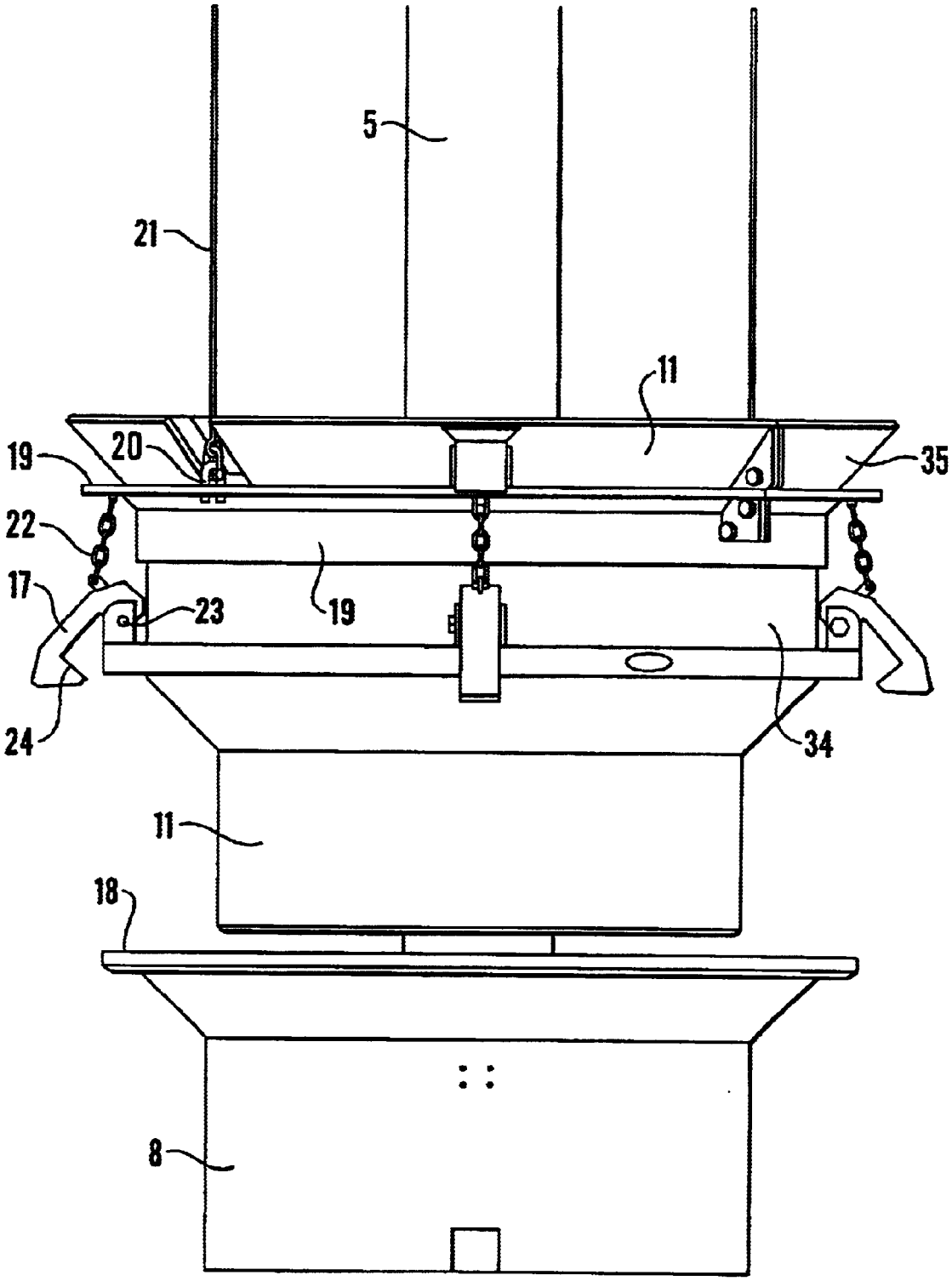
FIGS. 11–14 illustrate the primary guide being lowered into the permanent guide.

In FIG. 11 the primary guide 11 is suspended from the wires 21. The tension of the wires 21 also holds the lifting ring 19 in its upper position, and the hooks 17 are in their free position.

Figure 12:
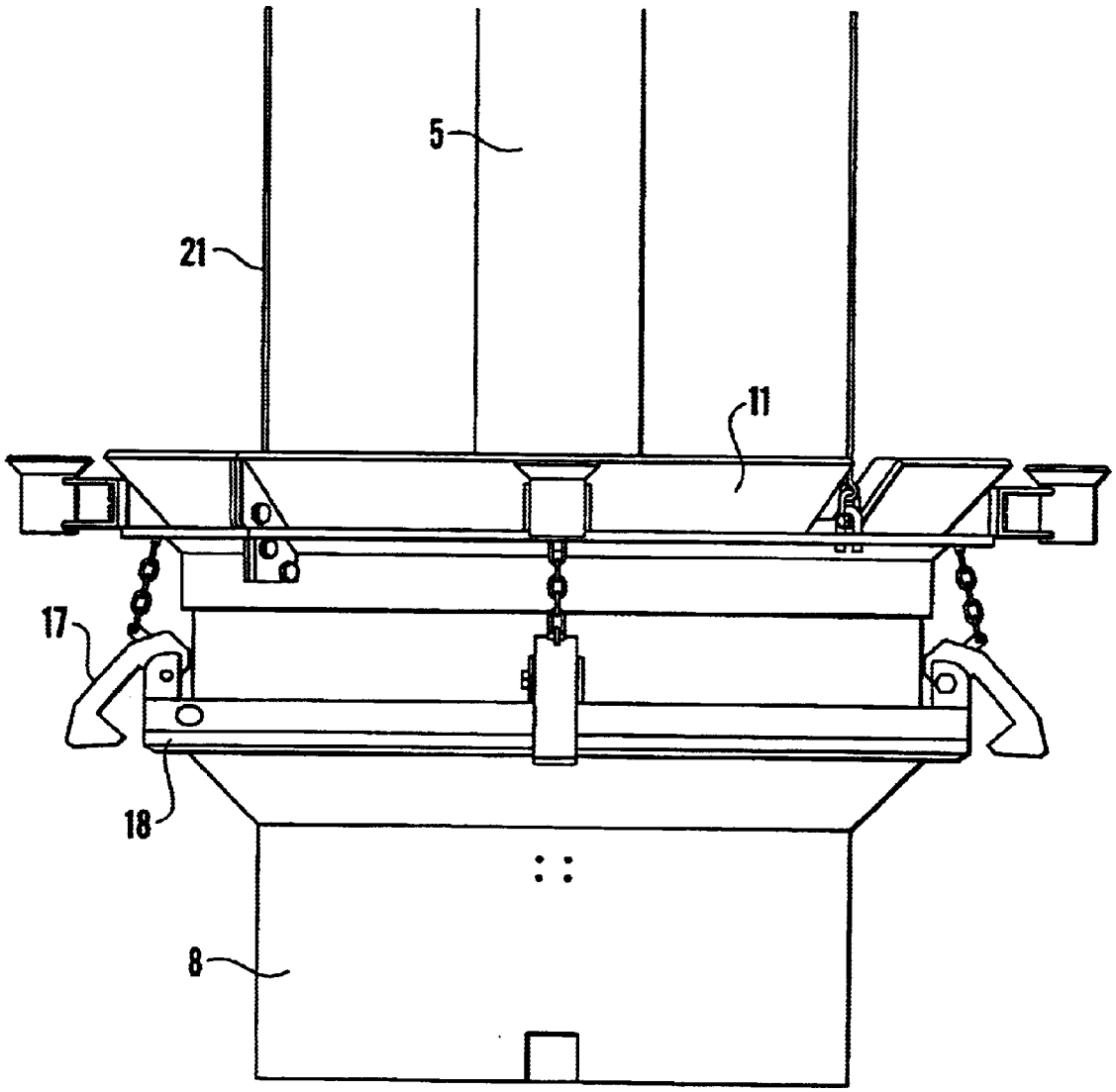

In FIG. 12 the primary guide 11 has been lowered down to and rests on the permanent guide 8. The wires 21 are still tensioned, and the hooks 17 are in their free position.

Figure 13:
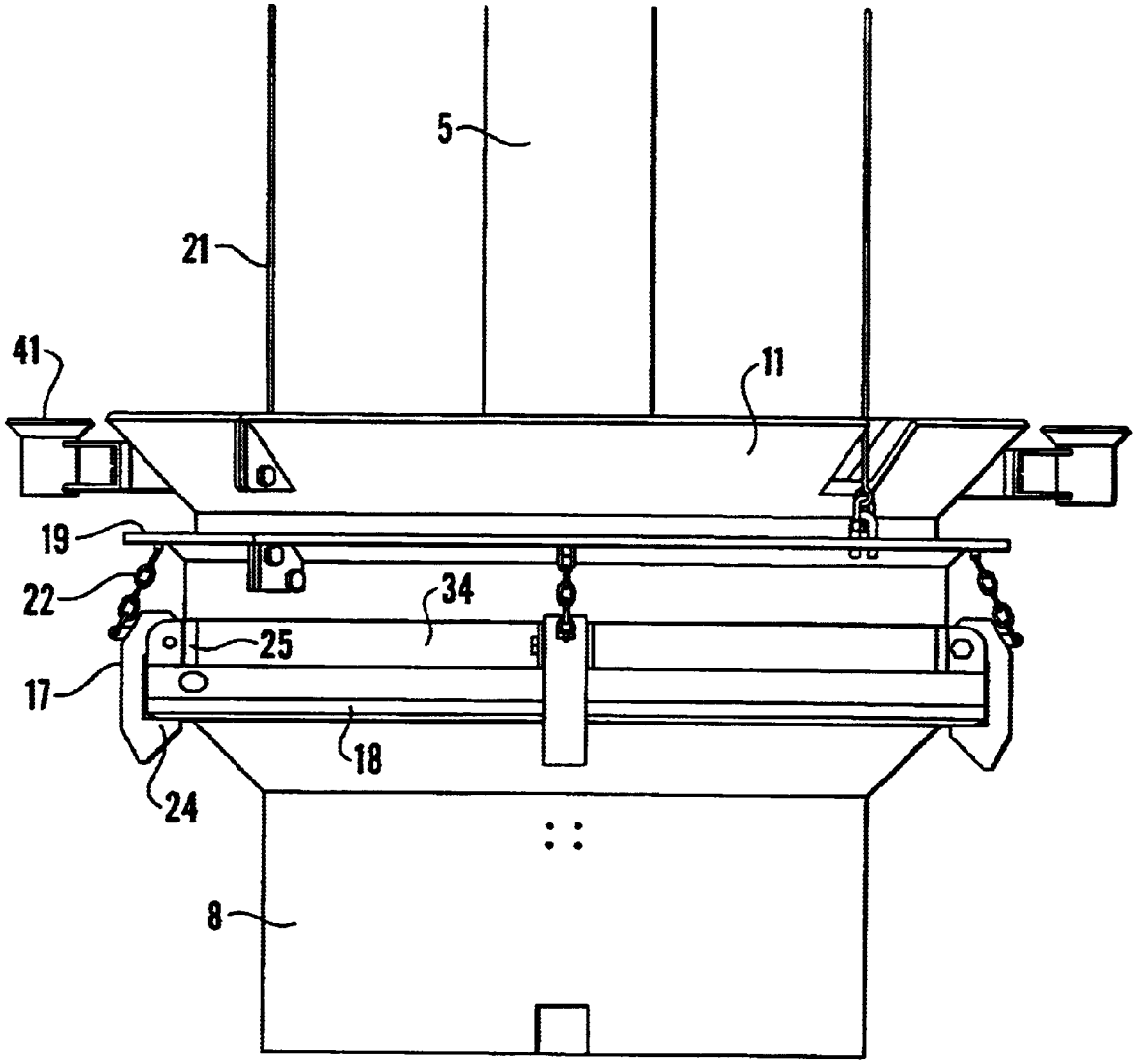

In FIG. 13 the wires 21 are about to be slackened. The lifting ring 19 has therefore moved somewhat down, and the hooks 17 have moved to their engaged position.

In FIG. 14 the wires 21 are slack. The lifting ring 19 has moved to its lower position, in the recesses 25 (see FIG. 13) between the hooks 17 and the upper cylindrical portion 34 of the primary guide 11. The hooks 17 are now locked in engaged position by the lifting ring 19.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A riser guide system for use on a floating offshore platform, the platform comprises a topside and a substructure having a lower pontoon, at least one riser extends from a subsea location to the topside, the system comprising:

a permanent guide having the shape of a housing and having a through-going opening for the riser, the permanent guide being secured to the pontoon, a primary guide having the shape of a housing and having a through-going opening for the riser, the primary guide being located in the permanent guide and being longitudinally divideable in two or more mechanically interconnectable parts, a secondary guide having the shape of a housing and having a through-going opening for the riser, the secondary guide being located in the primary guide, and riser guides located in the secondary guide and facing the riser.

2. The system of claim 1, wherein the primary guide is longitudinally divideable in two halves interconnectable by bolting.

3. A. The system of claim 1, wherein the secondary guide is longitudinally divideable in two or more mechanically interconnectable parts.

4. A riser guide system for use on a floating offshore platform, the platform comprises a topside and a substructure having a lower pontoon, at least one riser extends from a subsea location to the topside, the system comprising:

a permanent guide having the shape of a housing and having a through-going opening for the riser, the permanent guide being secured to the pontoon, a primary guide having the shape of a housing and having through-going opening for the riser, the primary guide being located in the permanent guide, a secondary guide having the shape of a housing and having a through-going opening for the riser, the secondary guide being located in the primary guide, and riser guides located in the secondary guide and facing the riser, the primary guide is provided with hooks and the permanent guide is provided with at least one holding element engageable by the hooks, for securing the primary guide to the permanent guide.

5. The system of claim 4, wherein the holding element is formed by a radially projecting flange of the permanent guide.

6. The system of claim 4, wherein the hooks are movable between a free position in which the primary guide can be lifted up from the permanent guide and an engaged position in which the hooks engage the holding element of the permanent guide, and the primary guide is provided with at least one lifting element provided with connections for lifting gear, and which is connected to the hooks via mechanical links, the lifting element is movable between an upper position in which the lifting element via the mechanical links has lifted the hooks to free position, the lifting element and the primary guide can thereby be lifted by the lifting gear, and a lower position in which the hooks are in engaged position and the lifting element locks the hooks in engaged position.

7. The system of claim 6, wherein the lifting element in its upper position abuts the primary guide.

8. The system of claim 6, wherein the hooks are provided with gripping portions engageable with the holding element, the hooks are pivotable about horizontal axes located above the gripping portions, and the mechanical links are connected to the hooks radially outwards from the axes.

9. The system of claim 6, wherein the mechanical links are formed by chains.

10. The system of claim 6, wherein the lifting element is formed by a lifting ring which is slideable on the outside of the primary guide.

11. The system of claim 6, wherein the lifting element in lower position is located with small clearances in recesses between the hooks and the primary guide, the lifting element thereby blocks movement of the hooks and locks the hooks in engaged position.

12. The system of claim 4, further comprising at least one lifting element connected to the hooks, the at least one lifting element in a lower position being located with small clearances in recesses between the hooks and the primary guide, the lifting elements thereby blocking movement of the hooks and locking the hooks in an engaged position.

13. A method for removing riser guides on a floating offshore platform, the platform comprises a topside and a substructure having a lower pontoon, at least one riser extends from a subsea location to the topsides, the riser guides face the riser and are located in a secondary guide having the shape of a housing and having a through-going opening, the secondary guide is located in a primary guide having the shape of a housing and having a through-going opening, the primary guide is located in a permanent guide having the shape of a housing and having a through-going opening, the permanent guide is secured to the pontoon, the riser extends through the openings of the secondary guide, the primary guide and the permanent guide, wherein the method comprises the following steps:

lifting the primary guide including the secondary guide up from the permanent guide to the topside, removing the riser guides from the secondary guide, and dividing the primary guide into at least two parts and removing them from the secondary guide after the primary guide and the secondary guide have been lifted up to the topside.

14. The method of claim 13, comprising a step of dividing the secondary guide into at least two parts and removing them from the primary guide after the primary guide and the secondary guide have been lifted up to the topside.

* * * * *